United States Patent [19]

Andersson

[11] Patent Number: 4,751,801

[45] Date of Patent: Jun. 21, 1988

[54] POST FOR TRAFFIC SIGNALS AND THE LIKE

[76] Inventor: Ake Andersson, Granes vag 3, Sigtuna, Sweden, 19300

[21] Appl. No.: 893,328

[22] PCT Filed: Oct. 25, 1985

[86] PCT No.: PCT/SE85/00417

§ 371 Date: Jul. 17, 1986

§ 102(e) Date: Jul. 17, 1986

[87] PCT Pub. No.: WO86/03238

PCT Pub. Date: Jun. 5, 1986

[51] Int. Cl.[4] ..... E01F 9/01; E04C 1/00

[52] U.S. Cl. ..... 52/98; 52/296; 404/10

[58] Field of Search ..... 52/98, 296, 298, 116, 52/117, 38, 40; 248/514, 349, 515, 511, 530, 156; 403/98; 404/10; 256/1

[56] References Cited

U.S. PATENT DOCUMENTS

| | | | |
|---|---|---|---|
| 840,241 | 1/1907 | Nootbaar | 248/515 |
| 1,162,608 | 11/1915 | Hohl et al. | 248/514 |
| 1,814,664 | 7/1931 | Cahill et al. | 256/1 |
| 2,698,474 | 1/1955 | Tittl | 248/514 |
| 2,721,631 | 10/1955 | Honold | 52/116 |
| 3,332,666 | 7/1967 | Gray | 52/116 |
| 4,154,037 | 5/1979 | Anderson | 52/298 |

FOREIGN PATENT DOCUMENTS

| | | | |
|---|---|---|---|
| 1483485 | 8/1977 | United Kingdom | 404/10 |
| 2078829 | 1/1982 | United Kingdom . | |

*Primary Examiner*—James L. Ridgill, Jr.
*Attorney, Agent, or Firm*—Holman & Stern

[57] ABSTRACT

Post for traffic signals, signs, information signs and the like comprising a foundation part fixed to the ground and a post part connected to the foundation part by a shock absorbing coupling which allows the post part to be released from the foundation part without the latter being substantially separated from the ground fixation. Personal damage is eliminated or reduced in an unintentional collision with the post by the coupling (5) which consists of at least two telescopically cooperating parts, one fixed to the foundation part (1) and the other fixed to the post part (6), which parts have a cooperating direction of displacement arranged perpendicular to the longitudinal axis of the post, and which telescoping parts frictionally contact at cooperating surfaces so that a friction force is generated by relative displacement of the parts.

15 Claims, 4 Drawing Sheets

POST FOR TRAFFIC SIGNALS AND THE LIKE

BACKGROUND OF THE INVENTION

1. Cross Reference to Related Application(s)

This United States application stems from PCT International Application No. PCT/SE85/00417 filed Oct. 25, 1985.

2. Field of the Invention

The present invention relates to a post for traffic signals, signs, information signs and the like and more particularly to a shock absorbing post comprising a foundation part fixed to the ground and a post part, which when subjected to an external shock force absorbs the energy thereof and/or is released from the foundation part without he latter being substantially separated from the ground fixation, the post part being connected to the foundation via a shock absorbing coupling.

3. Description of the Prior Art

Posts of a type related to that referred to above are known from e.g. U.S. Pat. No. 4,154,037 and GB Patent No. 2,078,829.

BRIEF SUMMARY OF THE INVENTION

The object of the present invention is to improve traffic posts of this type in order to decrease the risk of personal injury and damage occuring when a vehicle unintentionally collides with such a post. A further object of the invention is to provide a type of energy absorption coupling in the post structure such that in a minor collision by a vehicle the post in principle remains without being substantially deformed and without the vehicle being excessively damaged, or the post being totally destroyed. In a major collision the post can be separated from foundation without the foundation being damaged or separated from the ground. Thus, with the invention the full costs to restore the post to its original condition are eliminated as only a new coupling, an possibly a new post only, need be replaced on the foundation instead of having to remanufacture or remount both a post and a foundation. By means of the invention also the energy absorption ability of the coupling can be adapted to the shock energy which might occur when run into by a vehicle at the site where the post is placed. Thus, vehicles with a lower speed name, as known, a lower collision energy than those with a higher speed. An adaption to this fact can be made according to the invention Furthermore, the invention can be adapted to various weights in posts and the post according to the invention is useful for traffic signals and information signs, e.g. "overhead" signs.

BRIEF DESCRIPTION OF THE DRAWINGS

The invention will now be described in detail in certain embodiments with reference to the accompanying drawings wherein.

DETAILED DESCRIPTION

Figure 1:
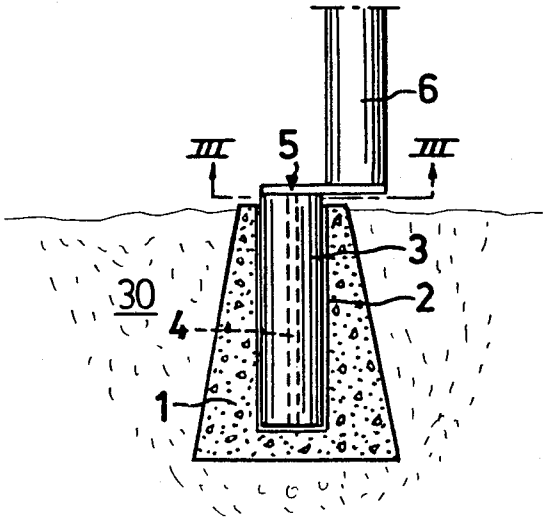
FIG. 1 is a vertical cross-sectional view through the foundation and showing a post according to the invention.

In FIG. 1 a foundation 1 is shown fixed to the ground 30 in a suitable and known manner. The foundation has a cylindrical cavity 2 into which a sleeve 3, or first post part, is inserted which is pivotable in the cavity 2 against resistance of e.g. friction between the sleeve 3 and the cavity 2. The cavity 2 thereby provides a first connection for the sleeve 3 to foundation 1. Alternatively or in addition thereto a torsion spring 4 can be inserted between the upper portion of the sleeve 3 and the bottom of the cavity 2 i.e., connected at the upper end to the upper part of sleeve 3 and at the lower end to foundation 1. The arrangement with the sleeve 3 in the cavity is, thus, to create a certain resistance against turning of the sleeve 3 in the cavity 2.

Figure 2:
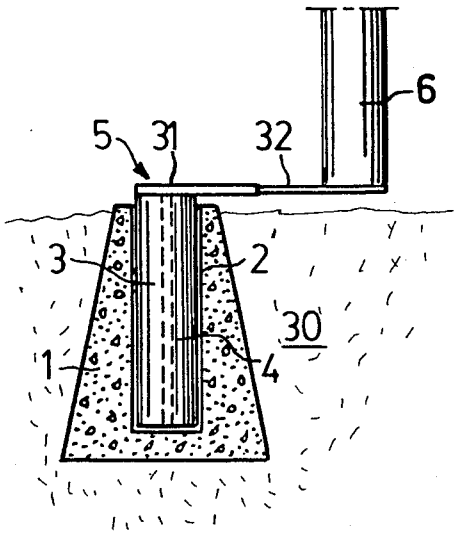
FIG. 2 is a view similar to FIG. 1 but showing the coupling in an extended position.

At the upper portion of the sleeve 3 a coupling 5 is arranged. The coupling consists of two telescopically cooperating parts 31, 32, and extends perpendicular to the longitudinal extensions of the post part 3 and 6. The coupling is described more in detail in an embodiment in relation to FIGS. 4 and 5 below. One portion 31 of the coupling is connected to the upper portion of the sleeve 3 and the other portion 32 of the coupling is connected to the second post part, the lower portion 6 of which is shown in FIGS. 1 and 2. Thus, the coupling can be extended by a force in the direction of displacement of the telescopic coupling.

FIG. 2 shows the coupling in its extended position after the second post part 6 has been hit forcibly from the left in the drawing. In the case shown, the force was minor enough to allow the shock energy to be absorbed by the telescopically cooperating parts through friction forces between them. This provides a first shock absorber.

Figure 3:
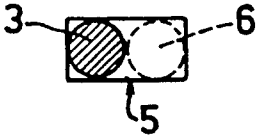
FIG. 3 is a schematic cross-sectional view taken along line III—III in FIG. 1.

FIG. 3 shows schematically in a section taken along line III—III in FIG. 1, the upper portion of sleeve 3, coupling 5 and post part 6. Here, the coupling is in a retracted position.

The function of the post in a collision can briefly be described as follows. In a collision the post will first be turned in the foundation so that the coupling is brought in line with the collision direction. Thereafter, the telescopically cooperating parts in the coupling will be pulled apart and these function as a kind of brake. If the vehicle, at this moment, has not come to a stand-still, the coupling parts 31, 32 will be completely pulled apart, whereby the post 6 with its connected part of the coupling will be driven by the vehicle forwards. The foundation 1 with its connected parts remains in its original ground fixation.

Figure 4:
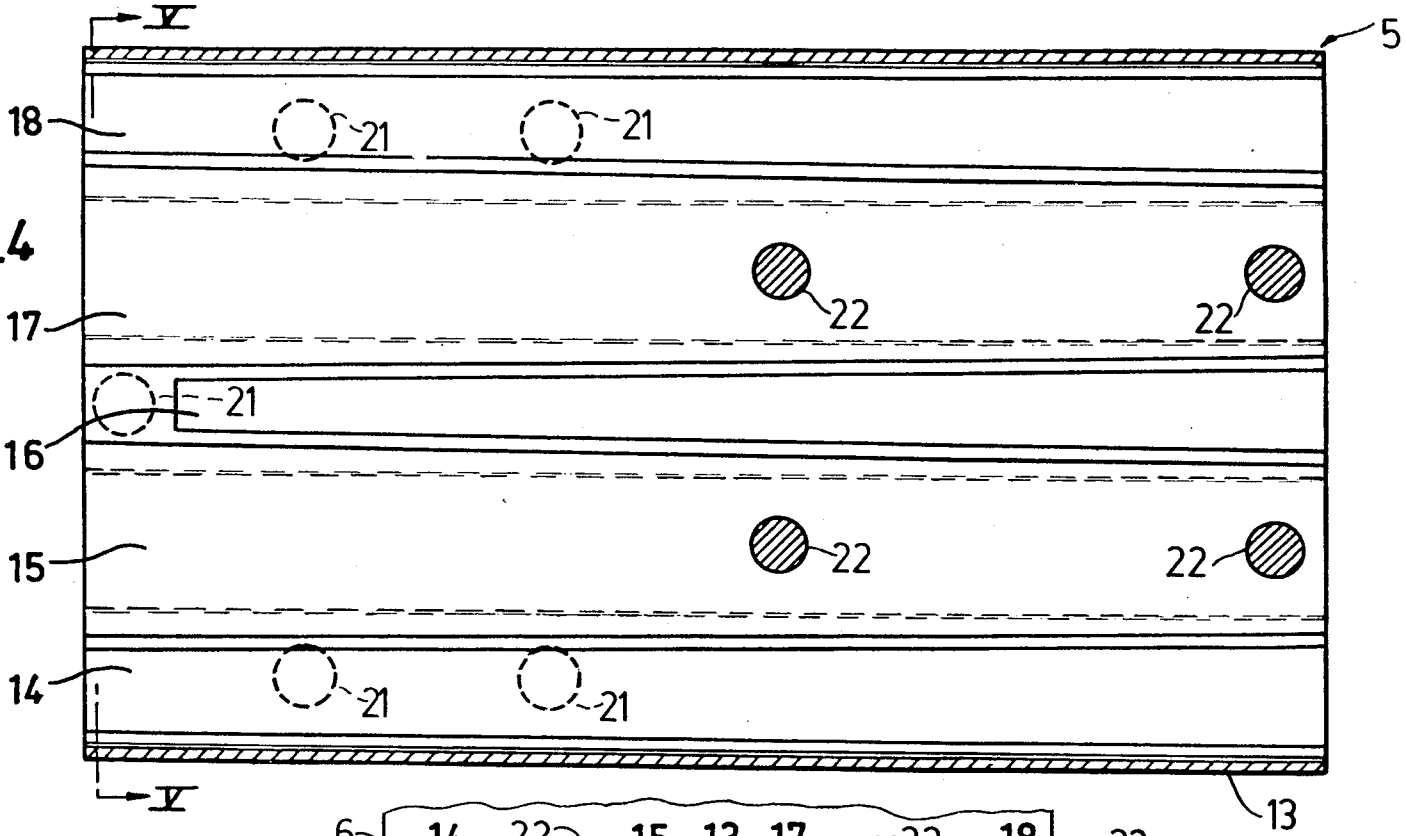
FIG. 4 is a longitudinal cross-sectional view through the coupling taken along line IV—IV in FIG. 5.
Figure 5:
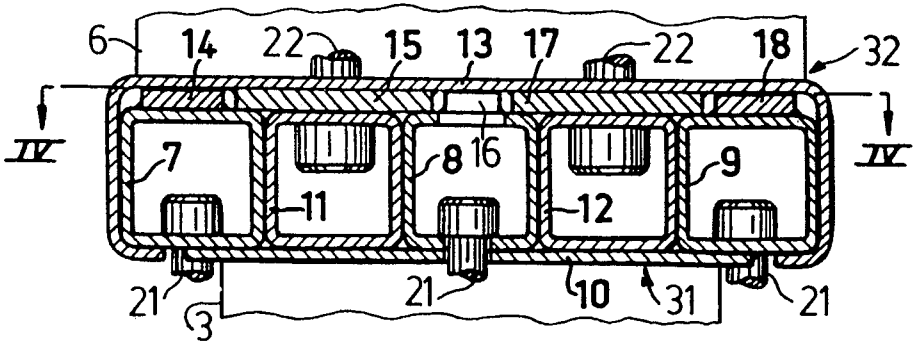
FIG. 5 is a cross-sectional view of the coupling taken along line V—V in FIg. 4.

With reference to FIGS. 4 and 5 a preferred embodiment of the coupling will now be described. FIG. 4 shows a longitudinal cross-section thereof and FIG. 5 shows a transverse cross-section. The coupling comprises five box beams placed side by side each having a square cross-section. The box beams 7, 8 and 9, respectively, are fastened to a bottom plate 10. The bottom plate 10 by suitable fasteners such as bolts, rivets, or pins 21, for example is fastened to the upper portion of the sleeve 3. The box beams 11 and 12 are fastened at 22, similarly to 21, channel type to a casing 13 partly enclosing the package of box beams so that box beams 7, 8, 9 are telescopically conneced within the framework formed by casing 13 and box beams 11, 12. The casing 13, thus, forms a type of guiding member for the package of box beams. The casing 13 which is connected to post part 6, and the bottom plate 10 will thus be displaced relative to each other when the box beams are displaced. Preferably, the package of box beams is held together in a manner such that friction forces occur between the sides of the box beams when displaced. However, a package of box beams arranged in the described manner is rather sensitive to temperature conditions and if, e.g., there is a low temperature, the friction forces between the box beams could be too great. In any case, the friction forces cannot be controlled with a sufficient accuracy, although it is clear that the friction forces in the static condition must not exceed the shock energy of a colliding vehicle, because in such a case the coupling looses its function as a shock absorbing mechanism. Furthermore, the length of the box beams are of importance to the energy absorption ability existing in the coupling.

Another, or alternative, energy absorbing mechanism exists in the coupling of this invention. This comprises five longitudinally wedge-shaped plates 14, 15, 16, 17 and 18 placed side by side. These plates are also attached to the box beams. Thus, the plate 14, the plate 16 and the plate 18 are attached to the box beams 7, 8 and 9, respectively, which are fastened to the bottom plate 10. The wedge-shaped plates 15 and 17 are fastened to the box beams 11 and 12 which are fastened to the casing 13. The wedge-shaped plates are slightly wedge-shaped. The wedge-shape is arranged so that the wedge action increases in the direction of extension of the coupling. Thus, as shown in FIG. 4, if the casing 13 is displaced to the right, the plates 15 and 17, with an increasing wedge-action, will be pressed towards the plates 14, 16 and 18, respectively, whereby the friction force will increase with the increase in the extension length for the coupling or the telescopically cooperating parts. Although not shown in detail it should be mentioned that each respective box beam is connected to the bottom plate or the casing 13 by suitable fastening means, such as bolts or welding for example, so that the box beams have the described relative displacement function.

Figure 6:
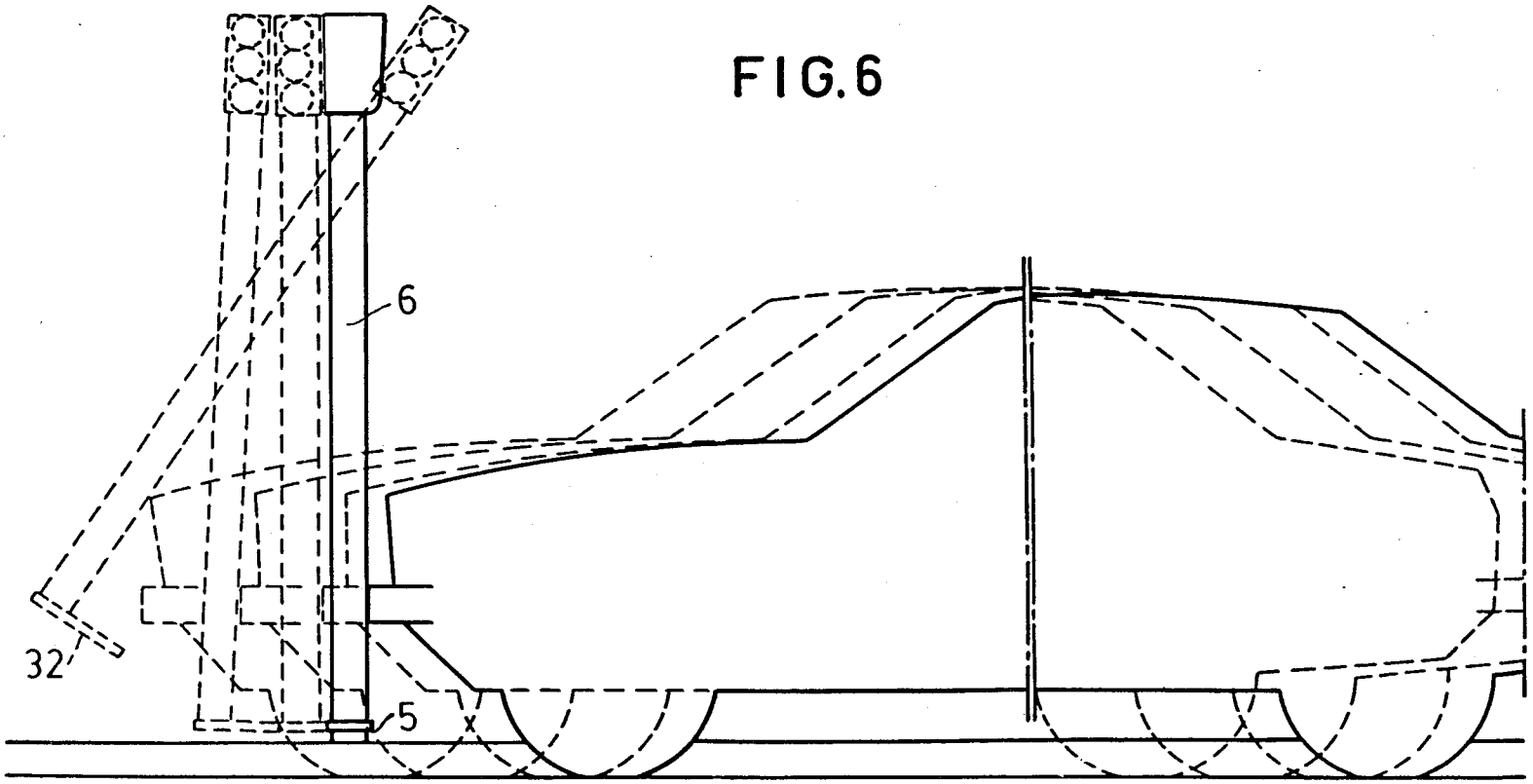
FIG. 6 is a schematic illustration of a vehicle colliding with the post according to the invention.

In FIG. 6 is schematically shown how the post according to the invention reacts when a vehicle collides with it. As previously mentioned, the coupling will absorb the shock energy from the vehicle. It should be noted that the foundation 1 of the post is placed so low that it is not directly impacted by the vehicle. If the post is fastened to the foundation in the manner shown in FIGS. 1 and 2 allowing the possibility for the coupling to turn in the foundation via the sleeve 3, the coupling will first turn so that the telescopically cooperating parts are brought into such a direction that the direction of relative displacement coincides with the driving direction of the colliding vehicle. Eventually the turning of the post is slowed down by friction between the sleeve 3 and the cavity 2 in the foundation, or in another way. Furthermore, the torsion spring shown in FIG. 1 can also absorb shock energy during the turning. When the turn is completed, or if no turning is effected, the coupling will absorb shock energy from the colliding vehicle. Thus, primarily, the coupling will be extended by the force of the colliding vehicle, If, after a maximum extension of the coupling, the vehicle still has not come to a stand-still, the coupling will be separated into two parts and the post will be disengaged from the foundation. Thereafter, the post will be further driven along with the vehicle until the vehicle stops. The foundation will be undamaged while the post has sustained damages dependant on the force of the impact. To the greatest possible extent thrusting of the post away causing injuries or damages to others is to be avoided.

Figure 9:
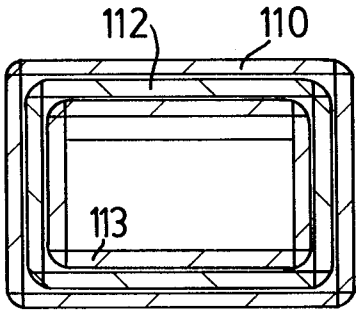
FIG. 9 is a cross-sectional view taken along line IX—IX in FIG. 7.
Figure 8:
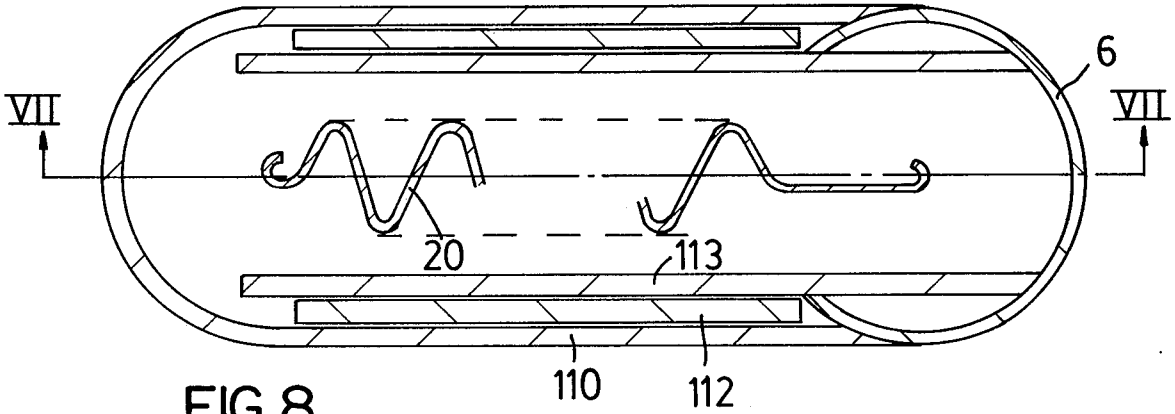
FIG. 8 is a cross-sectional view taken along line VIII—VIII in FIG. 7.
Figure 7:
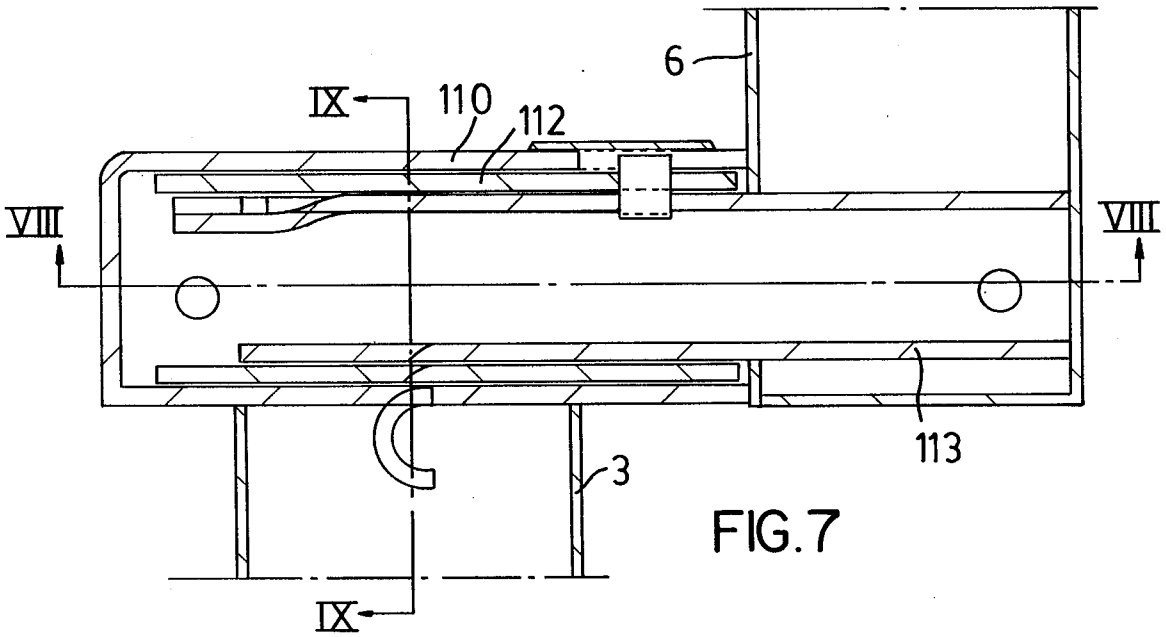
FIG. 7 is a longitudinal cross-sectional view taken along line VII—VII in FIG. 8 of another embodiment of the coupling of this invention.

FIGS. 7, 8 and 9 show another embodiment wherein the coupling comprises an outer box beam 110 and an inner box beam 113, and may also include intermediate box beam 112, telescopically arranged so that they are displaceable relative to each other. The energy absorbing means is in the form of a bent plate or rod 20 extendable upon separation of the coupling. Alternatively, an energy absorber in the form of piston-like means could be used, or a cooperation between two plates can be utilized wherein one of the plates is cut up by an element inserted into the second plate when the plates are displaced in relation to each other. The telescopically cooperating parts can thus have or comprise "braking mechanisms" of various shapes, fulfilling the function of the previously described wedge-plates, namely to absorb energy upon extension of the coupling. Furthermore, the two parts of the coupling can be adapted to be more or less releasable from the foundation and the post, respectively, so that, when practically all of the extendability has been utilized, the portion fixed to the foundation is released, or the portion fixed to the post is released.

I claim:

1. A post assembly installed in the ground for traffic signals, signs and similar purposes comprising:

a foundation fixed to the ground;

a first post part;

first connecting means for swingably connecting said first post part to said foundation;

a second post part;

telescoping coupling means connecting said second post part to said first post part; and first shock absorbing means operatively associated with said coupling means, so that shock caused by impact of an object on said second part will be absorbed by said coupling means;

said coupling means being separable so that said second post part is uncoupled from said first post part when the force of said impact exceeds the shock absorbing capacity of said shock absorbing means in the direction of impact, and said foundation is substantially unseparated from the ground.

2. A post assembly as claimed in claim 1 wherein said coupling means comprises:

first base means connected to said first post part;

second beam means connected to said second post part;

an element on said second beam means at least partly enclosing said first beam means so that said beam means are relatively telescopically displaceable; and said first shock absorbing means comprises a plurality of spaced first wedge-shaped members integral with said first beam means, a plurality of spaced second wedge-shaped members integral with said second beam means interposed between said first wedge-shaped members, said wedge-shaped members having wedge-surfaces interengageable upon relative displacement of said beams to produce increasing resistance to said displacement in the direction thereof.

3. A post assembly as claimed in claim 1 wherein said coupling means comprises:

first beam means connected to said first post part;

second beam means connected to said second post part;

an element on said second beam means at least partly enclosing said first beam means so that said beam means are relatively telescopically displaceable; and said first shock absorbing means comprises mutually contacting surfaces on said first and second beam means having frictional resistance to relative displacement of said beam means.

4. A post assembly as claimed in claim 3 wherein:

said second shock absorbing means comprises mutually contacting surfaces on said first post part and said foundation having frictional resistance to said relative rotation between said first post part and said foundation.

5. A post assembly as claimed in claim 3 wherein:

said first beam means comprises a plate member connected to said first post part and a plurality of spaced first box beams connected to said plate member; and said second beam means comprises a plurality of spaced second box beams interposed between said first box beams in contacting relationship with said first box beams at said mutually contacting surfaces and a casing member partly enclosing said box means and connected to said second post part.

6. A post assembly as claimed in claim 3 wherein:

said first beam means comprises a plate member connected to said first post part and a plurality of spaced first box beams connected to said plate member;

said second beam means comprises a plurality of spaced second box beams interposed between said first box beams in contacting relationship with said first box beams at said mutually contacting surfaces and a casing member partly enclosing said box beams and connected to said second post part; and said first shock absorbing means further comprises a plurality of spaced first wedge-shaped members integral with said first beam means, a plurality of spaced second wedge-shaped members integral with said second beamm means interposed between said first wedge-shaped members, said wedge-shaped members having wedge-surfaces interengageable upon relative displacement of said beams to produce increasing resistance to said displacement in the direction thereof.

7. A post assembly as claimed in claim 1 wherein:

said first connecting means comprises means for facilitating relative rotation between said first post part and said foundation.

8. A post assembly as claimed in claim 7 wherein:

said foundation is provided with a substantially vertically extending cylindrical cavity;

said first post part comprises a sleeve having a cylindrical outer surface rotatably supported in said cavity;

said second post part extends substantially vertically; and said coupling means has end portions connected respectively to said first and second post parts so that said second post part is swingable substantially horizontally about the axis of rotation of said first post part.

9. A post assembly as claimed in claim 7 wherein:

said coupling means comprises an outer box beam connected to said first post part, and an inner box beam supported telescopically within and movable relatively to said outer box beam; and said first shock absorbing means comprises a deformable elongated plate member disposed within said inner box beam having a bent configuration and adapted to extend longitudinally upon relative displacement of said box beams.

10. A post assembly as claimed in claim 7 and further comprising:

second shock absorbing means operatively associated with said first connecting means for absorbing shock from said impact.

11. A post assembly as claimed in claim 10 wherein:

said second shock absorbing means comprises mutually contacting surfaces on said first post part and said foundation having frictional resistance to said relative rotation between said first post part and said foundation.

12. A post assembly as claimed in claim 10, wherein:

said second shock absorbing means comprises torsion spring means operatively connected between said first post part and said foundation for resisting said relative rotation between said first post part and said foundation.

13. A post assembly as claimed in claim 10 wherein:

said foundation is provided with a substantially vertically extending cylindrical cavity;

said first post part comprises a sleeve having a cylindrical outer surface rotatably supported in said cavity;

said second post part extends substantially vertically; and said coupling means has end portions connected respectively to said first and second post parts so that said second post part is swingable substantially horizontally about the axis of rotation of said first post part.

14. A post assemby as claimed in claim 10 wherein said coupling means comprises:

first beam means connected to said first post part;

second beam means connected to said second post part;

an element on said second beam means at least partly enclosing said first beam means so that said beam means are relatively telescopically displaceable; and said first shock absorbing means comprises mutually contacting surfaces on said first and second beam means having frictional resistance to relative displacement of said beam means.

15. A post assembly as claimed in claim 14 wherein:

said second shock absorbing means comprises torsion spring means operatively connected between said first post part and said foundation for resisting said relative rotation between said first post part and said foundation.

* * * * *